US005724779A

United States Patent [19]

Chang

[11] Patent Number: 5,724,779

[45] Date of Patent: Mar. 10, 1998

[54] PARTITION WALL UNIT

[76] Inventor: Ching-Chang Chang, No. 323, Chien-Feng Rd., Feng-Tien Li, Ping-Tung City Ping-Tung Hsien, Taiwan

[21] Appl. No.: 734,446

[22] Filed: Oct. 18, 1996

[51] Int. Cl.[6] ..... E04B 2/74

[52] U.S. Cl. ..... 52/239; 52/36.1; 52/126.4; 52/220.7; 52/656.1; 52/777; 52/800.12

[58] Field of Search ..... 52/36.1, 126.3, 52/126.4, 220.7, 239, 242, 456, 656.1, 777, 778, 779, 780, 800.11, 800.12

[56] References Cited

U.S. PATENT DOCUMENTS

| | | | |
|---|---|---|---|
| 3,053,354 | 9/1962 | Dielman | 52/242 |
| 3,261,625 | 7/1966 | Cripe | 52/239 |
| 4,630,417 | 12/1986 | Collier | 52/126.4 X |
| 4,905,428 | 3/1990 | Sykes | 52/126.4 |
| 5,024,030 | 6/1991 | Morrison | 52/36.1 |
| 5,490,357 | 2/1996 | Lin | 52/220.7 |
| 5,537,795 | 7/1996 | Dias | 52/36.1 X |
| 5,592,794 | 1/1997 | Tundaun | 52/220.7 |

FOREIGN PATENT DOCUMENTS

| | | | |
|---|---|---|---|
| 2030891 | 7/1991 | Germany | 52/239 |

*Primary Examiner*—Wynn E. Wood
*Assistant Examiner*—Timothy B. Kang
*Attorney, Agent, or Firm*—Varndell Legal Group

[57] ABSTRACT

A partition wall unit including a bottom rail, a plurality of unit panels detachably connected with one another and supported on the bottom rail, and a bottom cover channel covered on the bottom rail at the bottom, the unit panel including a first top sash, a second top sash detachably connected to the first transverse top sash at the bottom, a first intermediate sash, a second intermediate sash detachably connected to the first intermediate sash at the bottom, a bottom sash, a first front face panel and a first rear face panel detachably connected in parallel between the second top sash and the first intermediate sash, a second front face panel and a second rear face panel detachably connected in parallel between the second intermediate sash and the bottom sash, a first upper stile profile and a second upper stile profile bilaterally and detachably connected between the second top sash and the first intermediate sash to hold the first front face panel and the first rear face panel in place, and a first lower stile profile and a second lower stile profile bilaterally and detachably connected between the second intermediate sash and the bottom sash to hold the second front face panel the second rear face panel in place.

2 Claims, 5 Drawing Sheets

PARTITION WALL UNIT

BACKGROUND OF THE INVENTION

The present invention relates to a partition wall unit which can be conveniently and detachably set up, and adjusted to the desired elevation.

A variety of partition wall assemblies have been disclosed. These partition wall assemblies can be conveniently set up in site. However, these partition wall assemblies cannot be conveniently connected at angles, or adjusted to fit the height of the installation space.

SUMMARY OF THE INVENTION

It is one object of the present invention to provide a partition wall unit which can be conveniently set up, and connected with one another at angles. It is another object of the present invention to provide a partition wall unit which can be conveniently adjusted to fit the height of the installation space. It is still another object of the present invention to provide a partition wall unit which is detachable and replaceable. According to one aspect of the present invention, the partition wall unit comprises a bottom rail, a plurality of unit panels detachably connected with one another and supported on the bottom rail, and a bottom cover channel covered on the bottom rail at the bottom, the unit panel including a first top sash, a second top sash detachably connected to a bottom side of the first top sash, a first intermediate sash, a second intermediate sash detachably connected to the first intermediate sash at the bottom, a bottom sash, a first front face panel and a first rear face panel detachably connected in parallel between the second top sash and the first intermediate sash, a second front face panel and a second rear face panel detachably connected in parallel between the second intermediate sash and the bottom sash, a first upper stile profile and a second upper stile profile bilaterally and detachably connected between the second top sash and the first intermediate sash to hold the first front face panel and the first rear face panel in place, and a first lower stile profile and a second lower stile profile bilaterally and detachably connected between the second intermediate sash and the bottom sash to hold the second front face panel and the second rear face panel in place. According to another aspect of the present invention, adjusting screws and nuts are installed in the bottom rail and supported on the bottom cover channel, and adapted for adjusting the elevation of the unit panels on the bottom cover channel through a rotary motion.

DETAILED DESCRIPTION OF THE PREFERRED EMBODIMENT

Figure 1:
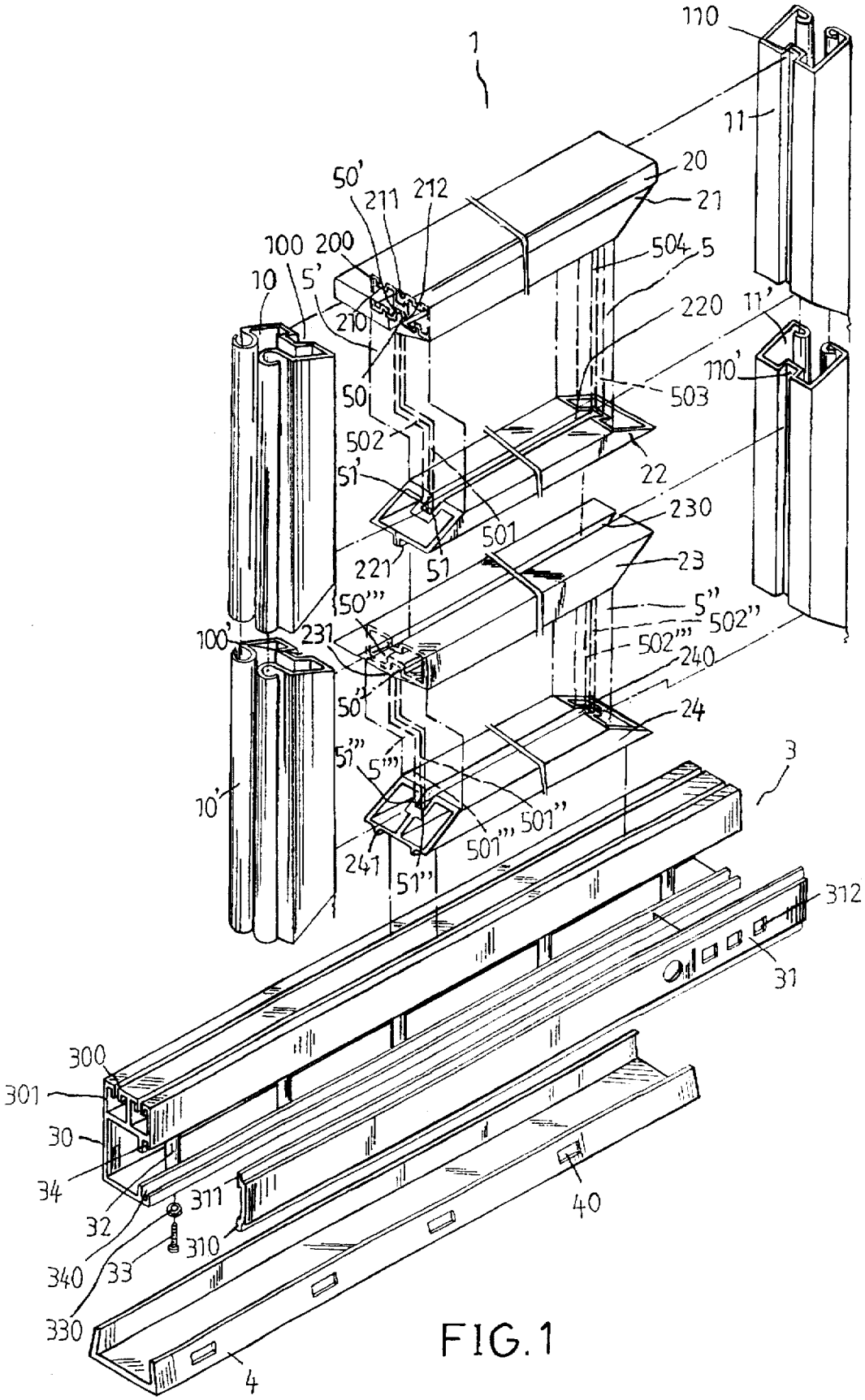
FIG. 1 is an exploded view of the present invention.
Figure 2:
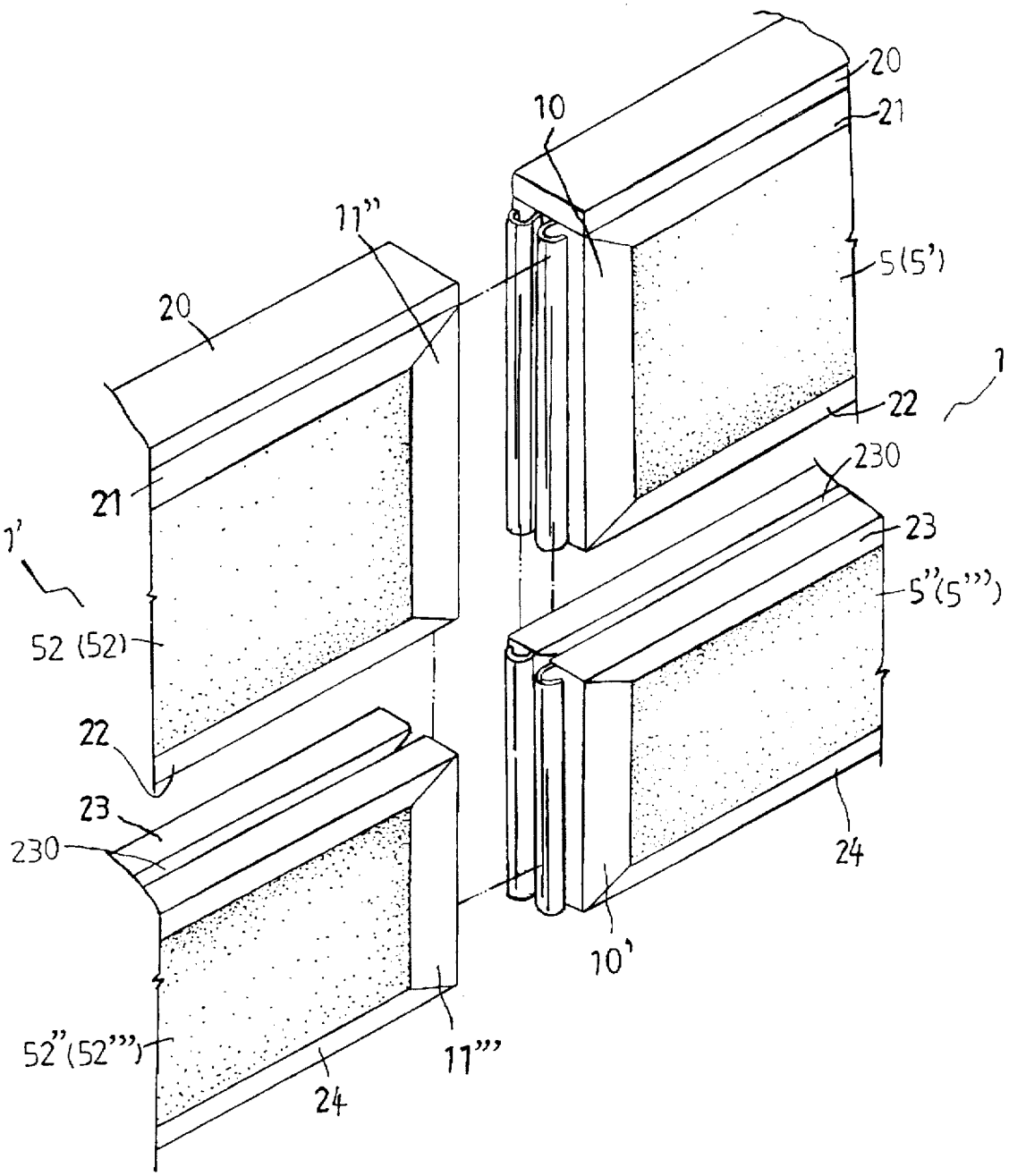
FIG. 2 is an assembly view of the unit panels of the present invention (not finished)
Figure 3:
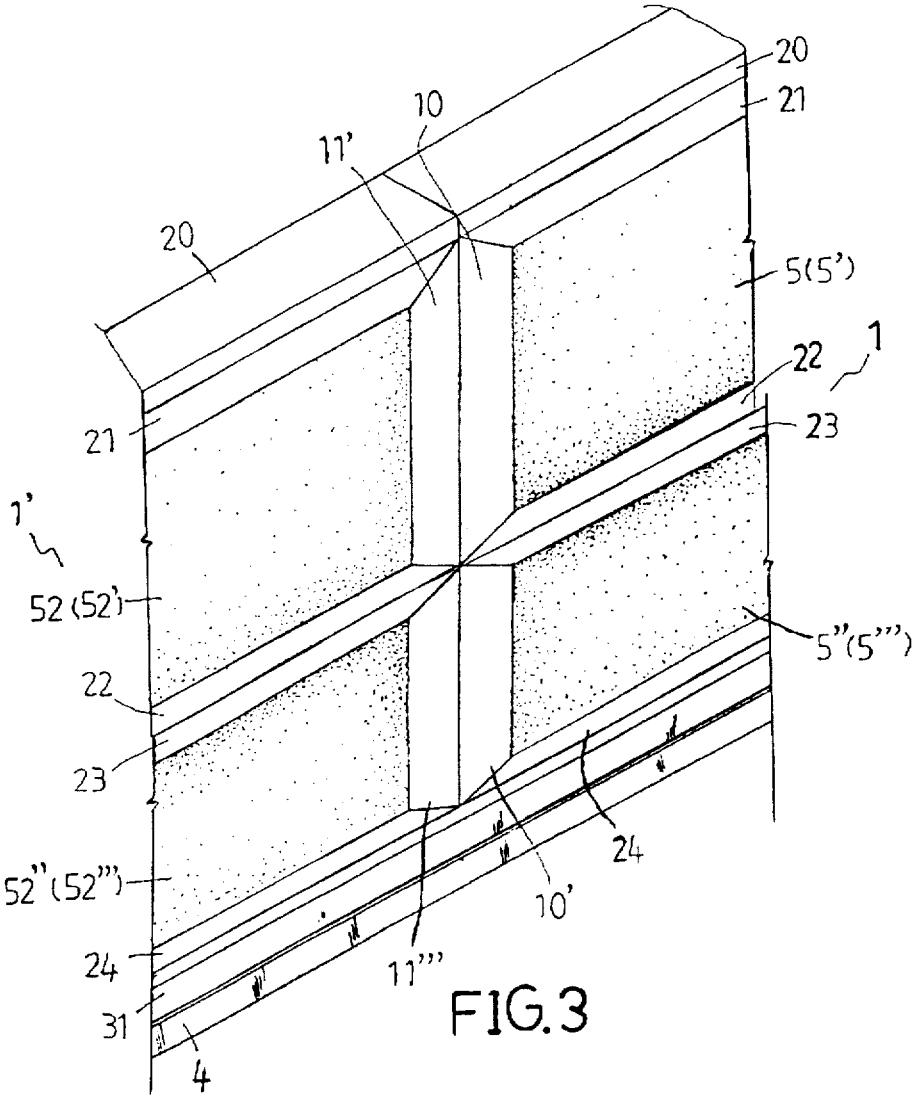
FIG. 3 is an assembly view of the unit panels of the present invention (finished)
Figure 4:
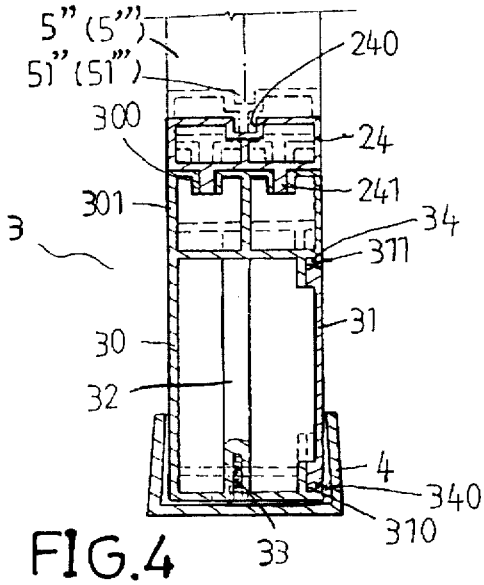
FIG. 4 is a sectional side view of the partition wall unit according to the present invention.
Figure 6:
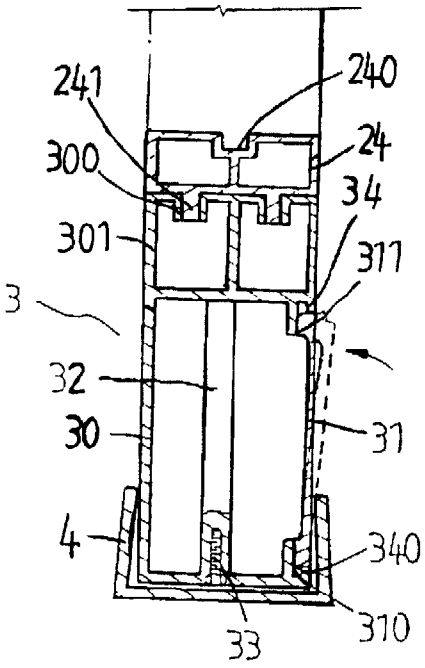
FIG. 6 is another sectional side view of the partition wall unit of the present invention, showing the installation of the cover plate in the elongated base frame of the bottom rail.
Figure 5:
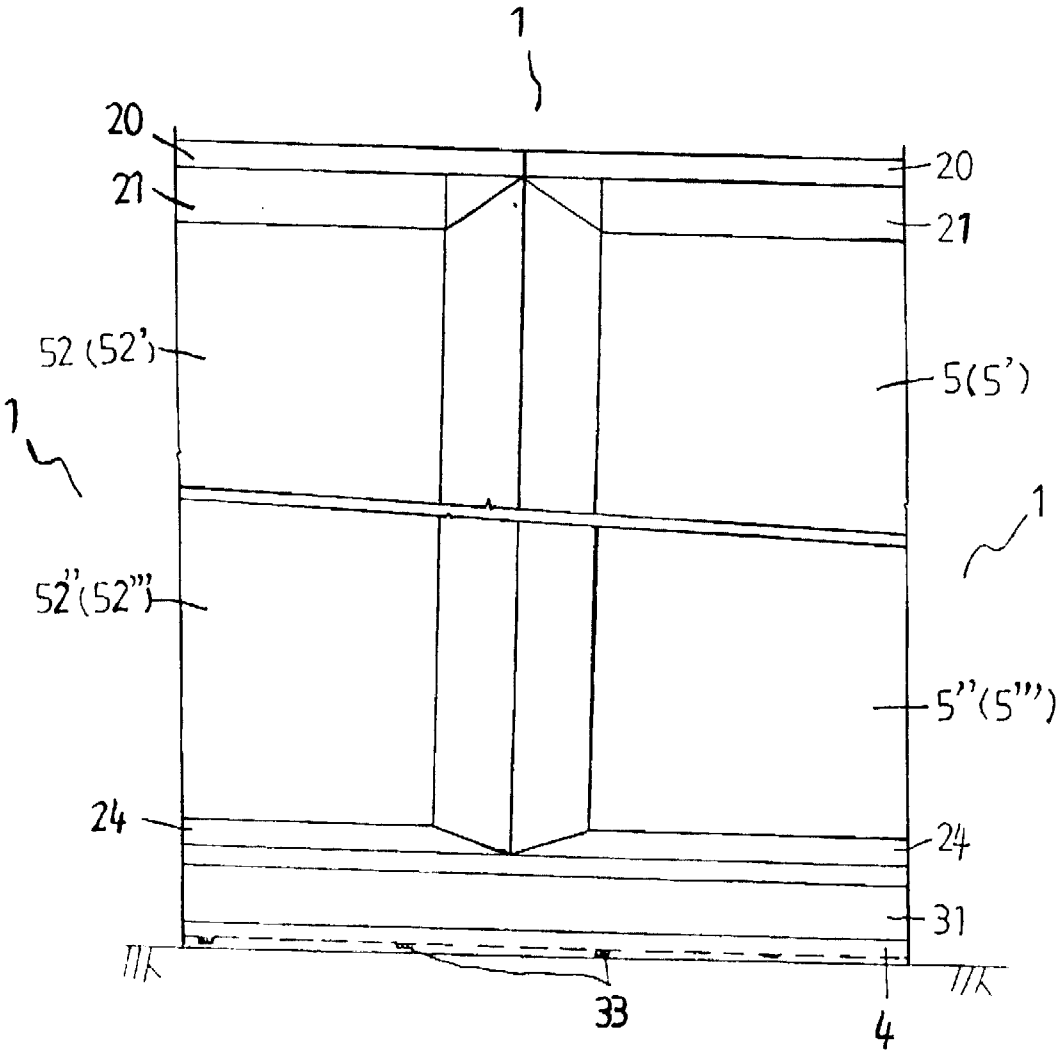
FIG. 5 is a front plain view of the partition wall unit according to the present invention.

Referring to FIGS. 1, 2, and 3, a partition wall unit in accordance with the present invention is generally comprised of a plurality of unit panels 1, 1' connected with one another by tongue-and-groove joints, a bottom rail 3, and a bottom cover channel 4.

Referring to Figures from 4 to 6, and Figures from 1 to 3 again, the unit panel 1 comprises a first top sash 20, a second top sash 21 connected to a bottom side of the first top sash 20, a first intermediate sash 22 spaced from and disposed in parallel to the second top sash 21, a second intermediate sash 23 connected to a bottom side of the first intermediate sash 22, a bottom sash 24 spaced from and disposed in parallel to the second intermediate sash 23, a first front face panel 5 and a first rear face panel 5' connected in parallel between the second top sash 21 and the first intermediate sash 22, a second front face panel 5" and a second rear face panel 5'" connected in parallel between the second intermediate sash 23 and the bottom sash 24, a first upper stile profile 10 and a second upper stile profile 11 bilaterally connected between the second top sash 21 and the first intermediate sash 22 to hold the first front face panel 5 and the first rear face panel 5' in place, and a first lower stile profile 10' and a second lower stile profile 11' bilaterally connected between the second intermediate sash 23 and the bottom sash 24 to hold the second front face panel 5" and the second rear face panel 5'" in place. The first top sash 20 has two downward coupling flanges 200 raised from the bottom side along the length. The second top sash 21 comprises two longitudinal sash coupling grooves 210 bilaterally disposed at the top along the length and forced into engagement with the downward coupling flanges 200 of the first top sash 20, a longitudinal top center groove 211 equally spaced between the longitudinal sash coupling grooves 210, and a longitudinal bottom center groove 212. The first intermediate sash 22 comprises a longitudinal top center groove 220 at the top, and a downward coupling flange 221 at the bottom. The second intermediate sash 23 comprises a longitudinal top center groove 230 at the top forced into engagement with the downward coupling flange 221 of the first intermediate sash 22, and a longitudinal bottom center groove 231 at the bottom. The bottom sash 24 comprises a longitudinal top center groove 240, and two downward coupling flanges 241 bilaterally raised from the bottom side along the length. The upper stile profiles 10, 11 have a respective longitudinal coupling groove 100, 110 at an inner side. The lower stile profiles 10', 11' have a respective longitudinal coupling groove 100', 110' at an inner side. The first front face panel 5 and the first rear face panel 5' have a respective top flange 50, 50' abutted against each other and fitted into the longitudinal bottom center groove 212 of the second top sash 21, a respective bottom flange 51, 51' abutted against each other and fitted into the longitudinal top center groove 220 of the first intermediate sash 22, a respective left side flange 501, 502 abutted against each other and fitted into the longitudinal coupling groove 100 of the first upper stile profile 10, a respective right side flange 503,504 abutted against each other and fitted into the longitudinal coupling groove 110 of the second upper stile profile 11. The second front face panel 5" and the second rear face panel 5'" have a respective top flange 50", 50'" abutted against each other and fitted into the longitudinal bottom center groove 231 of the second intermediate sash 23, a respective bottom flange 51", 51'" abutted against each other and fitted into the longitudinal top center groove 240 of the bottom sash 24, a respective left side flange 501", 501'" abutted against each other and fitted into the longitudinal coupling groove 100' of the first lower stile profile 10', a respective right side flange 502",502'" abutted against each other and fitted into the longitudinal coupling groove 110' of the second lower stile profile 11'. The bottom rail 3 is mounted within the bottom cover channel 4, comprised of an elongated base frame 30, and a cover plate 31 covered on the elongated base frame 30. The base frame 30 comprises two longitudinal coupling grooves 300 bilaterally disposed at the top of the upper section 301 thereof and respectively coupled to the downward coupling flanges 241 of the bottom sash 24, two horizontal coupling grooves 34 and 340 vertically spaced at the front side and facing each other, a plurality of downwardly disposed vertical female screw rods 32, and adjusting screws 33 and nuts 330 respectively fastened to the female screw rods 32 and turned to adjust the elevation of the bottom rail 3 in the bottom cover channel 4. The cover plate 31 comprises two longitudinal coupling flanges 310, 311 raised along two opposite long sides thereof and respectively forced into engagement with the coupling grooves 34, 340 of the base frame 30, and a plurality of electric socket mounting holes 312. The bottom cover channel 4 is attached to a bottom side of the bottom rail 3, having a plurality of elongated slots 40 through which fingers can be inserted into the inside of the bottom cover channel 4 to turn the nuts 330.

Figure 8:
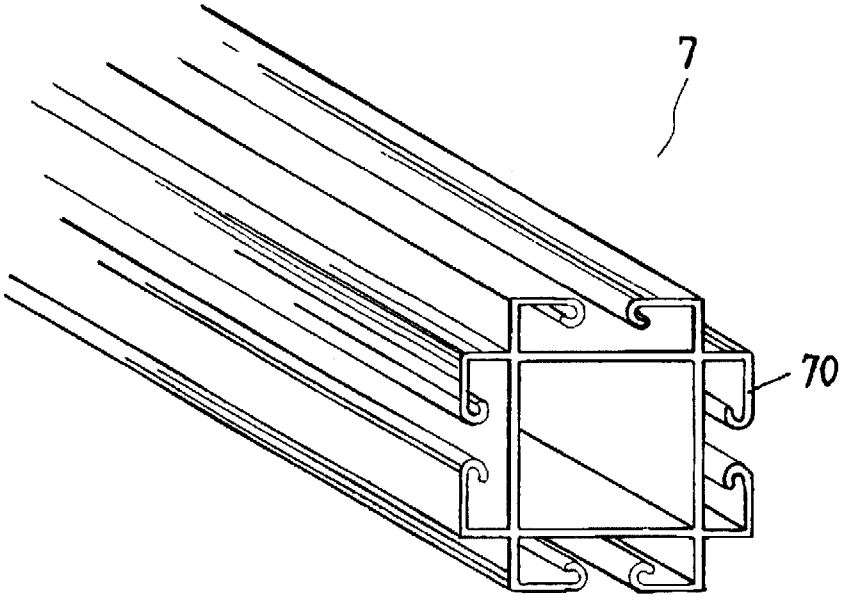
Figure 7:
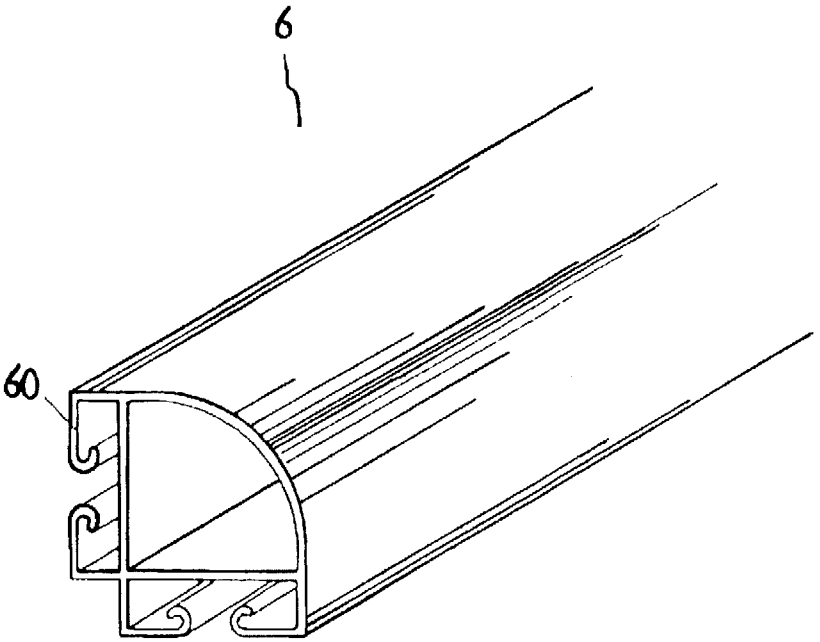
FIG. 7 is an elevational view of a first angle fitting according to the present invention; and, FIG. 8 is an elevational view of a second angle fitting according to the present invention.

Referring to FIGS. 7 and 8, angle fittings 6, which have coupling flanges 60 at two adjacent sides, and angle fittings 7, which have coupling flanges 70 at four sides, may be used to connect partition wall units at angles.

I claim:

1. A partition wall unit comprised of a bottom rail, a plurality of unit panels connected with one another by tongue-and-groove joints and supported on said bottom rail, and a bottom cover channel covered on said bottom rail at a bottom side, said unit panel comprising a first top sash, a second top sash connected to a bottom side of said first top sash, a first intermediate sash spaced from and disposed in parallel to said second top sash, a second intermediate sash connected to a bottom side of said first intermediate sash, a bottom sash spaced from and disposed in parallel to said second intermediate sash, a first front face panel and a first rear face panel connected in parallel between said second top sash and said first intermediate sash, a second front face panel and a second rear face panel connected in parallel between said second intermediate sash and said bottom sash, a first upper stile profile and a second upper stile profile bilaterally connected between said second top sash and said first intermediate sash to hold said first front face panel and said first rear face panel in place, and a first lower stile profile and a second lower stile profile bilaterally connected between said second intermediate sash and said bottom sash to hold said second front face panel and said second rear face panel in place, said first top sash having two downward coupling flanges raised from a bottom side thereof along the length, said second top sash comprising two longitudinal sash coupling grooves bilaterally disposed at a top side thereof along the length and forced into engagement with the downward coupling flanges of said first top sash, a longitudinal top center groove equally spaced between said longitudinal sash coupling grooves, and a longitudinal bottom center groove, said first intermediate sash comprising a longitudinal top center groove at a top side thereof, and a downward coupling flange raised from a bottom side thereof, said second intermediate sash comprising a longitudinal top center groove at a top side thereof forced into engagement with the downward coupling flange of said first intermediate sash, and a longitudinal bottom center groove at a bottom side thereof, said bottom sash comprising a longitudinal top center groove, and two downward coupling flanges bilaterally raised from a bottom side thereof, said first and second upper stile profiles having a respective longitudinal coupling groove at an inner side, said first and second lower stile profiles having a respective longitudinal coupling groove at an inner side, said first front face panel and said first rear face panel having a respective top flange abutted against each other and fitted into the longitudinal bottom center groove of said second top sash, a respective bottom flange abutted against each other and fitted into the longitudinal top center groove of said first intermediate sash, a respective left side flange abutted against each other and fitted into the longitudinal coupling groove of said first upper stile profile, a respective right side flange abutted against each other and fitted into the longitudinal coupling groove of said second upper stile profile, said second front face panel and said second rear face panel having a respective top flange abutted against each other and fitted into the longitudinal bottom center groove of said second intermediate sash, a respective bottom flange abutted against each other and fitted into the longitudinal top center groove of said bottom sash, a respective left side flange abutted against each other and fitted into the longitudinal coupling groove of said first lower stile profile, a respective right side flange abutted against each other and fitted into the longitudinal coupling groove of said second lower stile profile, said bottom rail being mounted within said bottom cover channel, and comprised of an elongated base frame and a cover plate attached to and covering said elongated base frame, said base frame comprising two longitudinal coupling grooves bilaterally disposed on a top side of an upper section thereof and respectively coupled to the downward coupling flanges of said bottom sash, two horizontal coupling grooves vertically spaced at a front side thereof and facing each other, a plurality of downwardly disposed vertical female screw rods, and adjusting screws and nuts respectively fastened to said female screw rods adjusting the elevation of said bottom rail in said bottom cover channel, said cover plate comprising two longitudinal coupling flanges raised along two opposite long sides thereof and respectively forced into engagement with the horizontal coupling grooves of said base frame, and a plurality of electric socket mounting holes, said bottom cover channel being attached to a bottom side of said bottom rail, having a plurality of elongated slots through which fingers can be inserted for turning said nuts inside said bottom cover channel.

2. The partition wall unit of claim 1 further comprising at least one first angle fitting having coupling flanges at two adjacent sides, and at least one second angle fitting having coupling flanges at four sides, adapted for connecting partition wall units at angles.

* * * * *